US009885463B2

(12) United States Patent
Sckenkl et al.

(10) Patent No.: US 9,885,463 B2
(45) Date of Patent: Feb. 6, 2018

(54) REFRIGERATING OR FREEZING APPARATUS WITH ILLUMINATED INTERIOR

(71) Applicant: emz-Hanauer GmbH & Co. KGaA, Nabburg (DE)

(72) Inventors: Johann Sckenkl, Bodenwoehr (DE); Manfredi Signorino, Milan (IT)

(73) Assignee: emz-Hanauer GmbH & Co. KGaA (DE)

( * ) Notice: Subject to any disclaimer, the term of this patent is extended or adjusted under 35 U.S.C. 154(b) by 102 days.

(21) Appl. No.: 14/940,529

(22) Filed: Nov. 13, 2015

(65) Prior Publication Data

US 2016/0138782 A1 May 19, 2016

(30) Foreign Application Priority Data

Nov. 17, 2014 (DE) ..... 10 2014 016 919

(51) Int. Cl.
*F21V 33/00* (2006.01)
*F21V 14/04* (2006.01)
(Continued)

(52) U.S. Cl.
CPC ..... *F21V 14/04* (2013.01); *F21V 14/02* (2013.01); *F25D 27/00* (2013.01); *F21W 2131/305* (2013.01); *F21Y 2115/10* (2016.08)

(58) Field of Classification Search
CPC ..... F21V 14/04; F21V 14/02; F21V 33/0004; F21V 19/02; F21V 21/14; F21V 21/30;
(Continued)

(56) References Cited

U.S. PATENT DOCUMENTS

2012/0085116 A1 4/2012 Maeng et al.
2013/0039059 A1 2/2013 Montgermont et al.
2014/0320040 A1* 10/2014 Katu ..... F25D 27/00 315/292

FOREIGN PATENT DOCUMENTS

DE 102013019099 A1 * 3/2014 ..... F25D 27/00
JP 2008-051366 A 3/2008
(Continued)

OTHER PUBLICATIONS

Espacenet English translation of German document DE 102013019099 A1.*
(Continued)

*Primary Examiner* — Elmito Breval
*Assistant Examiner* — Omar Rojas Cadima
(74) *Attorney, Agent, or Firm* — Robert R. Deleault, Esq.; Mesmer & Deleault, PLLC

(57) ABSTRACT

A refrigerating or freezing apparatus comprising an interior and a lighting device for illuminating the interior is presented. The lighting device includes in one embodiment a light-emitting element and a reflecting surface, in the direction of which the light-emitting element emits a light beam and by which the light beam is reflected in the direction of the interior. The lighting device further includes a drive device controlled by a control unit to adjust the light-emitting element with respect to the reflecting surface and thereby vary at least one of the radiating position and radiating direction of the light beam emitted by the light-emitting element relative to the reflecting surface.

15 Claims, 5 Drawing Sheets

(51) Int. Cl.

| | |
|---|---|
| ***F25D 27/00*** | (2006.01) |
| ***F21V 14/02*** | (2006.01) |
| *F21W 131/305* | (2006.01) |
| *F21Y 115/10* | (2016.01) |

(58) Field of Classification Search

CPC ..... F21V 23/00; F25D 27/00; F25D 27/005; F25D 2327/00; F25D 2327/001; F21Y 2115/10; F21W 2131/402; F21W 2131/305; F21S 4/20; F24F 2011/005

USPC ..... 362/33, 89, 92, 94, 154, 218, 220, 221, 362/217.02; 312/236; 62/264

See application file for complete search history.

(56) References Cited

FOREIGN PATENT DOCUMENTS

| | | | |
|---|---|---|---|
| JP | 2008-284939 | A | 11/2008 |
| KR | 10-2012-003225 | A | 4/2012 |

OTHER PUBLICATIONS

Office action in priority German application dated Jul. 24, 2015, DE Appl. No. 10 2014 016 919.7 filed Nov. 17, 2014.

KR office action in co-pending application KR 10-2015-159590 dated Jun. 20, 2016.

* cited by examiner

REFRIGERATING OR FREEZING APPARATUS WITH ILLUMINATED INTERIOR

BACKGROUND OF THE INVENTION

1. Field of the Invention

The present invention relates generally to techniques for illuminating the interior of a refrigerating or freezing apparatus.

2. Description of the Prior Art

It is convenient for the user if at least parts of the interior of a refrigerating or freezing apparatus are illuminated when he or she opens an access door or access lid of the apparatus in order to put in or take out objects. The interior is that space into which the objects (foodstuffs) to be kept refrigerated or frozen are placed. Particularly in the case of refrigerating apparatuses of the lower price category, often only a simple lamp is mounted at a suitable place in the interior, which is switched on when the door or lid is opened and provides a certain brightness at least in the immediate vicinity of the lamp. Furthermore, there are solutions in which light is radiated from the side into a narrow side of a transparent plate which forms, for example, a placement area for storing objects. With such an illuminating plate, the interior of the refrigerating or freezing apparatus can be illuminated at least to a certain extent. Moreover, such an illuminating plate creates a nice aesthetic effect.

SUMMARY OF THE INVENTION

It is an object of the present invention to provide a solution for an interior illumination with which the interior of a refrigerating or freezing apparatus can be variably illuminated.

The present invention achieves this and other objectives by providing a refrigerating or freezing apparatus which comprises an interior and a lighting device for illuminating the interior. The lighting device includes at least one light-emitting element and a reflecting surface arrangement, in the direction of which the light-emitting element emits a light beam and by which the light beam is reflected in the direction of the interior. For the variable illumination of the interior, the lighting device further includes an actuating device to change at least one of the radiating position and radiating direction of the light beam emitted by the light-emitting element relative to the reflecting surface arrangement. By changing at least one of the radiating position and radiating direction of the light beam relative to the reflecting surface arrangement, a variation of at least one of the direction, position and divergence of the light beam radiated by the reflecting surface arrangement into the interior and thus a variation of the illumination profile of the interior are obtained. In this way, different regions of the interior can be selectively more or less intensely illuminated as required.

The refrigerating or freezing apparatus according to the invention may comprise exclusively a refrigerating function, exclusively a freezing function or both. In the latter case, a lighting device may be provided solely in association with a refrigerating region of the combined refrigerating and freezing apparatus, solely in association with a freezing region of the apparatus or in association with each of the two regions. With regard to its construction, the refrigerating or freezing apparatus according to the invention may have a cabinet or chest form. In the case of the cabinet form, the refrigerating or/and freezing apparatus includes at least one vertically standing access door, through which the interior of the apparatus is accessible. In the case of a chest form by contrast, it has a horizontally lying chest lid delimiting the interior upwards.

The variation of at least one of the radiating position and radiating direction of the light beam emitted by the light-emitting element may be achieved according to one embodiment by the light-emitting element being arranged positionally adjustably relative to the reflecting surface arrangement. The actuating device in this case comprises a drive device for the positional adjustment of the light-emitting element. Alternatively, at least part of the reflecting surface arrangement may be arranged positionally adjustably relative to the light-emitting element. In this case, the actuating device comprises a drive device for the positional adjustment of the relevant part of the reflecting surface arrangement. Moreover, it is also not excluded that both the light-emitting element and at least part of the reflecting surface arrangement are positionally adjustably arranged and can be adjusted by a drive device included in the actuating device.

When a positional adjustability is referred to here, this adjustability can be expressed in at least one of an adjustability of the position in space and an adjustability of an angular position. Accordingly, the positional adjustability of the light-emitting element or/and of the reflecting surface arrangement may comprise an adjustability having at least one translational component and—alternatively or additionally thereto—having at least one rotatory component.

Of course, there is not excluded in the context of the invention a suitable electronic control of the light-emitting element itself, in order to cause, without positional adjustment of the same, a variation of at least one of the radiating position and radiating direction of the emitted light beam relative to the reflecting surface arrangement.

According to one embodiment, the light-emitting element is mounted on a printed circuit board which is positionally adjustable by means of the drive device—for example formed by an electric motor.

The reflecting surface arrangement may include a reflecting surface concavely curved in at least one sectional plane. The light-emitting element may be positionally adjustable in the sectional plane relative to this reflecting surface. In the case of an adjustability with at least one translational component, the light-emitting element may be movable in the direction from one edge region of the concavely curved reflecting surface to an opposite edge region of the same. In the case of an adjustability with at least one rotatory degree of freedom, the light-emitting element may be adjustable about an axis of rotation perpendicular to the sectional plane with respect to its angular position relative to the reflecting surface.

In a configuration in which the interior is delimited by a back wall, two side walls opposite one another, a top wall and a bottom wall, the light-emitting element may be positionally adjustable in a sectional plane of the reflecting surface which runs parallel to the side walls. When in this case the light-emitting element and at least part of the reflecting surface arrangement associated therewith are arranged on the top wall, the conditions are fulfilled for radiating the light beam, radiated into the interior by the reflecting surface arrangement, in the manner of a light curtain from the top downwards, it being possible for this curtain to be directed downwards at different angles depending on the set position of the light-emitting element. In this way, it is possible to illuminate alternately front, central and rear regions of a placement plate for the refrigerated or frozen goods to be stored. Of course, a light curtain of such variable adjustability can also be created by adjusting the concavely curved reflecting surface in the sectional plane.

In one embodiment, the reflecting surface is formed by a reflecting trough, wherein the lighting device includes a plurality of light-emitting elements arranged in a manner distributed in the trough longitudinal direction. The plurality of the light-emitting elements may in this case be positionally adjustable relative to the reflecting trough on a common support along a sectional plane perpendicular to the trough longitudinal direction. The common support may, for example, be a printed circuit board on which the plurality of the light-emitting elements is mounted. Of course, in the context of the invention, an individual positional adjustability of a single one or a plurality of the light-emitting elements is not excluded.

According to an embodiment of the invention, the actuating device may comprise a control unit adapted to cause a change of at least one of the radiating position and radiating direction of the light beam in accordance with a predetermined variation profile. The variation profile specifies, for example, the manner in which at least one of the radiating direction and radiating position of the light beam emitted by the light-emitting element is to be changed with respect to the reflecting surface arrangement after the opening of the refrigerating or freezing apparatus (i.e. when a user opens an access door or access lid). For example, it is conceivable to program the variation profile such that, after the opening of the refrigerating or/and freezing apparatus, the focus of the illumination gradually moves from upper regions of the interior towards lower regions or/and from front regions of the interior towards rear regions.

for the actuating device to comprise a control unit adapted to cause a change of at least one of the radiating position and radiating direction of the light beam based on sensory-acquired information with regard to at least one of a user of the apparatus and an interior state of the apparatus. In such a configuration, a situation-dependent adaptation of the illumination is possible, for example depending on the region of the interior into which a user reaches with his or her hand, or/and depending on the region of the interior into which the user looks with his or her eyes. For the sensory detection of such situations, the refrigerating or/and freezing apparatus may be equipped, for example, with an optical proximity sensor or/and with a camera. The proximity sensor emits a measuring beam (for example in the IR wavelength range) and detects the intensity of the returning IR radiation. The closer a reflecting object (e.g. the user's hand) is to the proximity sensor, the greater the returning radiation intensity. The detected intensity is thus a measure of the distance of the reflecting object from the proximity sensor. For this it can be determined whether the user is reaching with his or her hand, for example, into an upper compartment or into a lower compartment of the interior. The lighting device can then be controlled accordingly such that the compartment into which the user is reaching is illuminated more intensely. The same applies to a camera-based sensor system. A camera can also be used to detect where the user reaches with his or her hand into the interior of the refrigerating or/and freezing apparatus. Alternatively or additionally, the direction in which the user is looking can be detected by means of a camera and based on this a particular partial region of the interior of the refrigerating or/and freezing apparatus can be illuminated more intensely.

The state of the interior of the apparatus may relate, for example, to the degree of filling of the interior as a whole or of individual partial regions of the interior. Thus, it is conceivable that by image evaluation of camera-detected images the control unit determines, for example, those regions of the interior which are more heavily filled than other regions, and directs the lighting more intensely to the more heavily filled regions or leaves largely unlit at least those regions which are filled less or not at all.

The light-emitting element may be realized in light-emitting-diode technology.

A variable illumination of the apparatus interior may be realized not only via a variable interaction of the light-emitting element with at least part of the reflecting surface arrangement, but instead also via a variable interaction of the light-emitting element with at least one light-permeable element, through which at least part of the light of the light-emitting element travels. Accordingly, the lighting device can comprise, alternatively or additionally to the reflecting surface arrangement, at least one light-permeable element which influences the propagation of at least part of the light of the light-emitting element, the lighting device comprising an actuating device to change at least one of the radiating position and radiating direction of a light beam emitted by the light-emitting element relative to the light-permeable element. For example, the light-permeable element may have at least one of a lens function and a scattering function. When light permeability is referred to here, it is understood to mean both a permeability without transmission losses and a lossy permeability (i.e. translucence). The influencing of the light propagation may accordingly consist, for example, in at least one of a refraction, a diffraction, a scattering and an attenuation.

For the variation of at least one of the radiating position and radiating direction the same possibilities come into consideration as were explained above in connection with the reflecting surface arrangement. Thus, it is conceivable for either the light-emitting element or the light-permeable element or both to be positionally adjustably arranged. With regard to the concrete form of the positional adjustability, reference is made again to the variants explained above in connection with the reflecting surface arrangement. If there is only a variability of the radiating position and/or radiating direction of a light beam emitted by the light-emitting element relative to the light-permeable element, but not a variability of the radiating position and/or radiating direction of a light beam emitted by the light-emitting element relative to a reflecting surface arrangement, the actuating device specified in claim 1 can be dispensed with. If there is a variability of at least one of the radiating position and radiating direction of a light beam emitted by the light-emitting element relative to the light-permeable element and additionally thereto a variability of the radiating position and/or radiating direction of a light beam emitted by the light-emitting element relative to a reflecting surface arrangement, it is possible to use, at least partially, common components for the actuating device of claim 1 and for the actuating device of claim 16, for instance in the form of a common control unit.

The invention is explained in more detail below with reference to the appended drawings.

DETAILED DESCRIPTION

Figure 1:
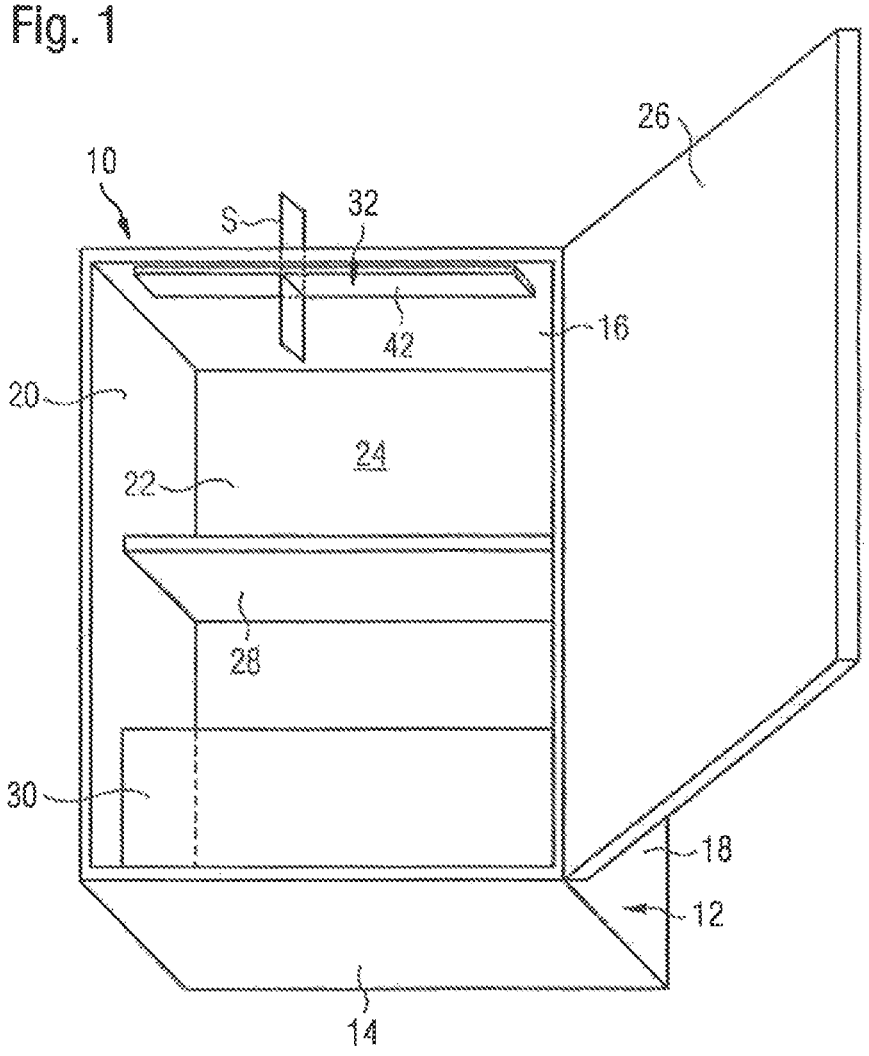
FIG. 1 shows schematically a refrigerating or freezing apparatus according to an embodiment.

Reference is made firstly to FIG. 1. The refrigerating or freezing apparatus illustrated there is designated generally by 10. It is of cabinet form and has a carcass 12 with a bottom wall 14, a top wall 16, two side walls 18, 20 and a back wall 22. A front access opening to an interior 24 of the refrigerating or freezing apparatus 10 is closable by a door 26 pivotably attached to the carcass 12. In the closed state of the refrigerating or freezing apparatus 10, the door 26 is opposite the back wall 22—as customary in cabinet-type objects.

In the exemplary case shown, a shelf 28 and a drawer 30 are arranged in the interior 24 of the refrigerating or freezing apparatus 10. The shelf 28 serves as a placement plate in order to place thereon objects to be kept cool. It is understood that a plurality of shelves 28 may be provided, if necessary. The drawer 30 also serves for storing goods to be cooled. Again it is understood that two or more drawers 30 may be present, if necessary.

A lighting device, designated generally by 32, serves for illuminating the interior 24. When the door 26 is open, the lighting device 32 generates a light curtain which radiates from the top wall 16 downwards, i.e. in the direction of the bottom wall 14, and can pivot in the direction from the front towards the rear, so that selectively different regions of the interior 24 can be more intensely illuminated. Alternatively or additionally, it is conceivable to enable a pivoting of the light curtain in a plane parallel to the plane of the back wall 22 by suitable control of the lighting device 32. In this way too, it is possible for selectively different regions of the interior 24 to be more intensely illuminated.

In the exemplary case shown, the light-generating place of the light curtain is situated in the region of the top wall 16. Although in FIG. 1—due inter alia to the schematic representation—the lighting device 32 is shown such that it extends over only part of the width of the top wall 16, it is understood that the light curtain generated by the lighting device 32 may have a width corresponding substantially to the width of the interior of the refrigerating or freezing apparatus 10, i.e. may extend at least approximately from one of the side walls 18, 20 to the other.

Figure 2:
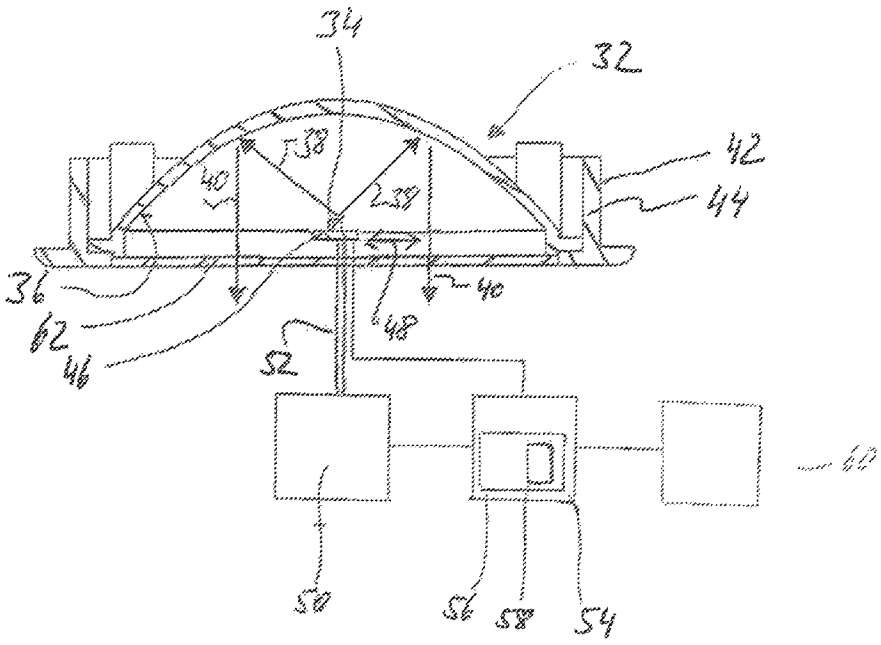
FIG. 2 shows schematically an embodiment of a lighting device for the refrigerating or freezing apparatus of FIG. 1.

Reference is now made additionally to FIG. 2. There, an embodiment of the lighting device 32 is shown in which a light-emitting element 34 is positionally adjustable relative to an immovably arranged reflecting surface 36, whereby the radiating position of a light beam emitted by the light-emitting element 34 (represented by beam arrows 38) with respect to the reflecting surface 36 changes, which in turn results in the light reflected by the reflecting surface 36 (represented by beam arrows 40) being radiated in a variable direction into the interior 24 of the refrigerating or freezing apparatus 10.

The lighting device 32 comprises a light module 42 which can be prefabricated to form a constructional unit and which has a module housing 44 serving as support for the light-emitting element 34 and the reflecting surface 36. The module housing 44 is designed (in a manner not shown in more detail) with suitable housing formations which allow the light module 42 to be fastened to the top wall 16 of the refrigerating or freezing apparatus 10. For example, these housing formations may comprise one or more fastening holes for inserting fastening screws. Alternatively or additionally, the housing formations may comprise, for example, one or more snap hooks, which allow a snap-latching of the light module 42 to the top wall 16 of the refrigerating or freezing apparatus 10. Expediently, there is formed in the top wall 16 an indentation or recess (not shown specifically in the drawings) which is adapted to the shape of the light module 42 and into which the light module 42 can be inserted for assembly. In the final-assembly state, the light module 42 projects, at most slightly, beyond the interior-side surface of the top wall 16.

The reflecting surface 36 is designed with a concave curvature, at least in the drawing plane of FIG. 2. The drawing plane of FIG. 2 corresponds to a sectional plane which is indicated at S in FIG. 1 and is oriented substantially parallel to the side walls 18, 20. In this sectional plane, the reflecting surface 36 forms a parabolic reflector. In the exemplary case shown, the reflecting surface 36 is of trough-shaped design, having in the trough longitudinal direction (corresponding to the normal direction to the drawing plane of FIG. 2) a substantially constant (or alternatively varying) trough cross-section. The trough shape of the reflecting surface 36 allows a plurality of light-emitting elements 34 to be provided spaced apart one behind the other in the trough longitudinal direction. This enables the generation of a sufficiently wide light curtain and the illumination of the interior 24 of the refrigerating or freezing apparatus 10 substantially over its entire width, i.e. from one of the side walls 18, 20 to the opposite one.

Alternatively to a trough-like configuration of the reflecting surface 36, it is conceivable for the reflecting surface 36 to be of calotte-shaped form, for example in the shape of a spherical calotte or a paraboloid of revolution. With such a configuration, a light-emitting element is arranged expediently only in the calotte centre. If a plurality of light-emitting elements are to be provided distributed over the width of the interior 24, accordingly a plurality of reflecting calottes can be mounted distributed on the top wall 16 of the refrigerating or freezing apparatus 10.

The reflecting surface 36 can be formed, for example, by a metallization applied to a suitably shaped base body. Alternatively, it is conceivable for the reflecting surface 36 to be formed by a (optionally polished) surface of a reflecting body produced from a sufficiently bright, for example white, plastics material.

Figure 3A:
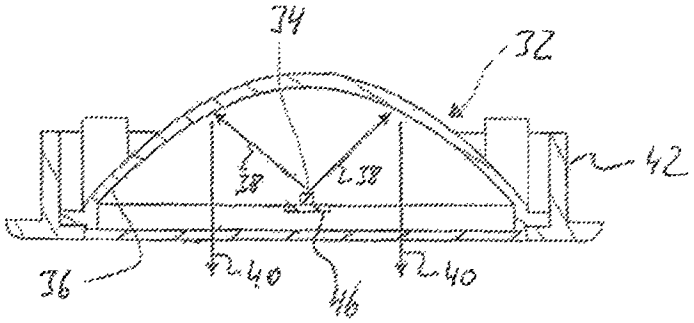
FIGS. 3A-3C show the lighting device of FIG. 2 in different setting states.
Figure 3B:
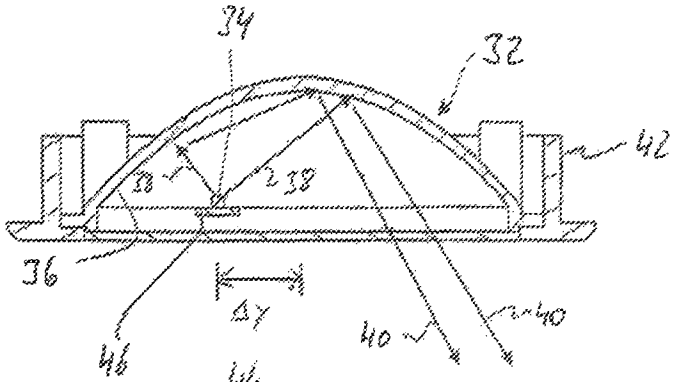
Figure 3C:
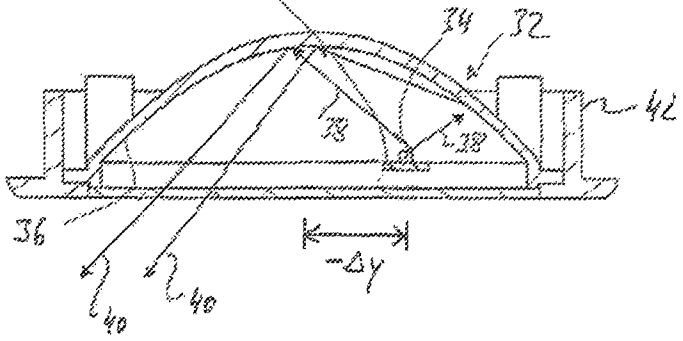

The light-emitting element 34, which is formed, for example, by an individual light-emitting diode (LED) or a group of different-colored light-emitting diodes, generates light in a wavelength spectrum which is suitable for illuminating the interior 24 of the refrigerating or freezing apparatus 10, and is mounted on a printed circuit board 46. If the reflecting surface 36 is of trough-like elongated design and a plurality of light-emitting elements 34 are arranged distributed in the trough longitudinal direction, the printed circuit board 46 can be designed as an elongated printed circuit board strip, on which all of the light-emitting element 34 are mounted. In the exemplary case shown, the printed circuit board 46 is movable, in the drawing plane of FIG. 2, in the direction from one edge of the reflecting surface 36 to the opposite edge. This movability is illustrated in FIG. 2 by a double-headed arrow 48. Owing to the fact that the printed circuit board 46 is moved in the direction of the arrow 48 relative to the stationary reflecting surface 36, the position at which the light beam emitted by the light-emitting element 34 strikes the reflecting surface 36 changes. As a result of the curvature of the reflecting surface 36, the direction (and possibly also the divergence or/and cross-sectional size) of the light beam reflected by the reflecting surface 36 in the direction of the interior 24 changes accordingly. This is illustrated in FIGS. 3A to 3C for three different exemplary setting states of the lighting device 32. While in FIG. 3A the printed circuit board 46 with the light-emitting element 34 mounted thereon is in a central position (zero position), the printed circuit board in FIG. 3B has moved to the left by a distance Δy relative to the reflecting surface 36 and in FIG. 3C has moved to the right by a distance −Δy. The beam arrows 40 marking the reflected ray beam illustrate in these figures in a readily discernible manner the varying direction of the light curtain radiated into the interior 24 depending on the direction and magnitude of the travel of the printed circuit board 46.

For the positional adjustment of the printed circuit board 46, the lighting device 32 has a drive device 50, represented schematically in FIG. 2, which may comprise, for example, an electromotive drive unit. The drive device 50 is in mechanical drive connection, indicated schematically at 52, with the printed circuit board 46. Various configurations are conceivable for realizing this drive connection 52. For example, the drive device may rotationally drive a threaded spindle (not shown specifically) which for its part is in threaded engagement with a threaded block coupled to the printed circuit board 46. The maximum movement stroke of the printed circuit board 46 may be, for example, in the range of millimeters or centimeters.

The drive device 50 is controlled by a control unit 54 which also controls the light emission of the light-emitting element 34 and for this purpose is in electrical signal connection with the printed circuit board 46. Together with the drive unit 50, the control unit 54 is part of an actuating unit in the meaning of the invention. The control unit 54 is, for example, program-controlled and for this purpose can comprise a memory 56 with a control program 58 stored therein. In one embodiment, the control program 58 contains instructions which define a predetermined profile of how the printed circuit board 46 is to be moved in response to an initiating event (e.g. opening of the door 26). This movement profile at the same time corresponds to a variation profile for the light curtain radiated into the interior 24 of the refrigerating or freezing apparatus 10. As an alternative to a movement profile of the printed circuit board 46 which is always the same and independent of other conditions, a setting of the lighting device 32 which varies depending on the situation is conceivable. For this purpose, a sensor 60 connected to the control unit 54 is shown schematically in FIG. 2, which sensor represents a suitable sensor system by means of which a current situation can be detected and indicated to the control unit 54. For example, a filling state of the refrigerating or freezing apparatus 10 can be detected as the current situation. A different illumination of the interior 24 may be desirable depending on the filling state, i.e. where in the refrigerating or freezing apparatus 10 which amount of goods to be cooled is situated. Another example of a current situation may be a user who reaches with a hand into the interior 24. By means of the sensor system (represented in FIG. 2 by the sensor 60) the region of the interior 24 into which the hand moves can be detected, so that this region can be more intensely illuminated. A further example of a current situation may be a pulling-out of the drawer 30. If the sensor system detects that the drawer 30 is being pulled out, the control unit 54 can control the light curtain generated by the lighting device 32 in such a way that the interior of the pulled-out drawer 30 is more intensely illuminated. For the detection of such situations, the sensor system may comprise, for example, an infrared sensor, operated as a proximity sensor, having an infrared transmitter and an infrared receiver. Alternatively or additionally, the sensor system may comprise, for example, a camera.

It is understood that the movability of the printed circuit board 46 indicated by the double-headed arrow 48 is not the only possibility for influencing the light curtain emitted by the lighting device 32. Alternatively or additionally, a tilting of the printed circuit board 46 about a tilting axis normal to the drawing plane of FIG. 2 is conceivable, and also a movement of the printed circuit board 46 along the sectional plane S, but perpendicular to the movement direction indicated by the double-headed arrow 48.

Figure 4A:
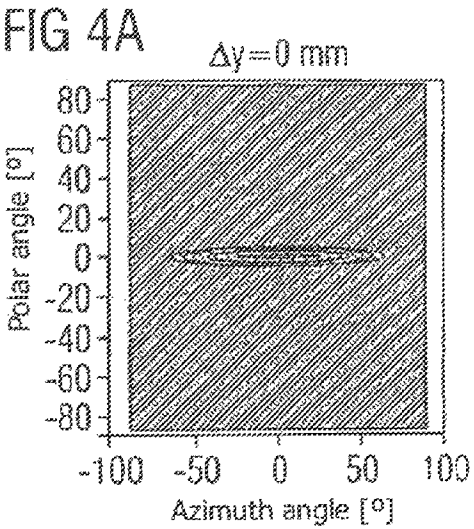
FIGS. 4A-4F show diagrams which illustrate a light intensity profile of the lighting device of FIG. 2 in different setting states.
Figure 4B:
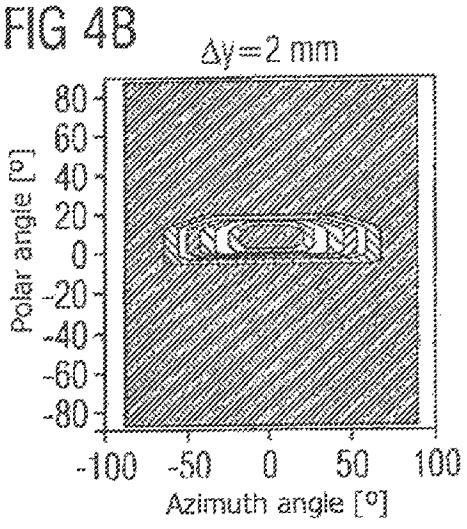
Figure 4C:
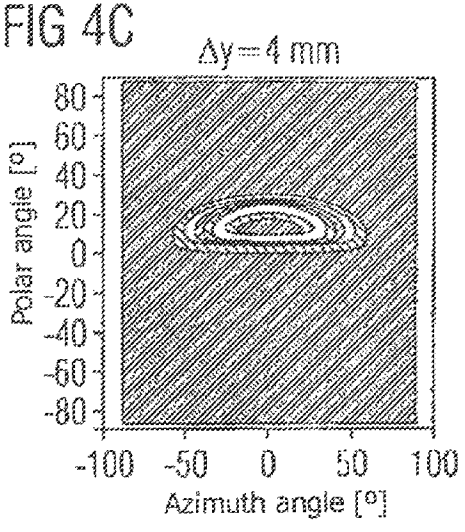
Figure 4D:
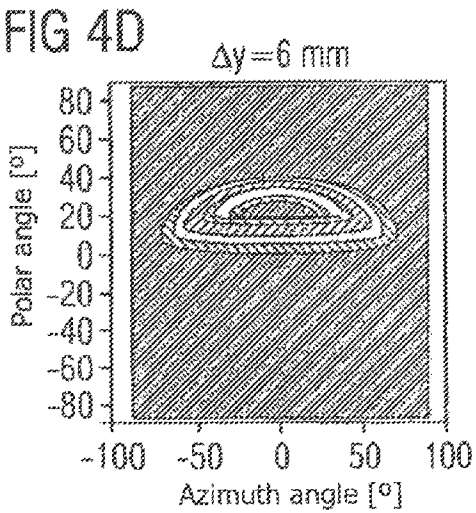
Figure 4E:
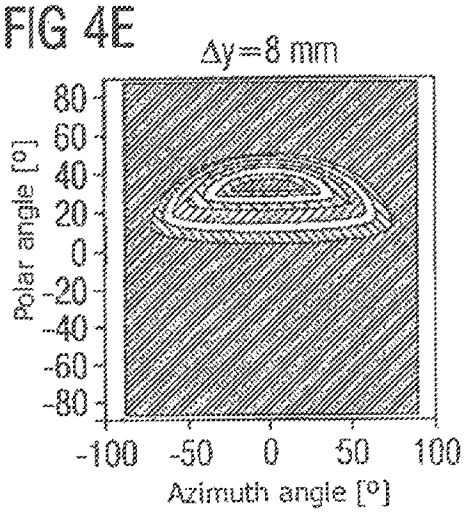
Figure 4F:
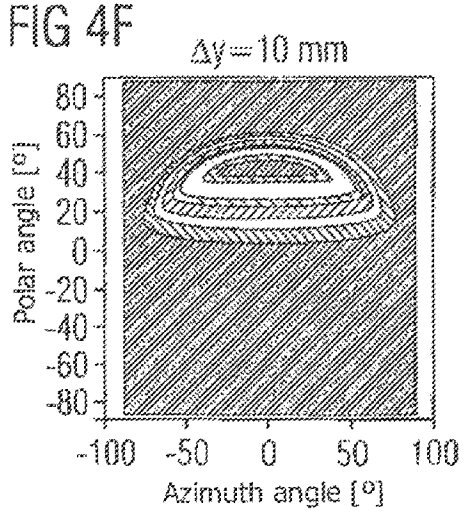

FIGS. 4A to 4F show exemplary light intensity profiles which may result for different magnitudes of the travel Δy in a concrete implementation of the lighting device 32. FIG. 4A corresponds to the situation Δy=0 mm, which reflects the setting situation according to FIG. 3A. FIG. 4B by contrast corresponds to the situation Δy=2 mm, and from figure to figure up to FIG. 4F the excursion Δy increases by 2 mm each. The axis of abscissas (horizontal axis) designates the azimuthal angle in FIGS. 4A to 4F, the axis of ordinates (vertical axis) the polar angle. The polar angle is measured along the sectional plane S (cf. FIG. 1) and specifies the angle with respect to a normal to the top wall 16. Assuming the refrigerating or freezing apparatus 10 stands in customary fashion with the bottom wall 14 parallel to the ground and the top wall 16 is oriented parallel to a horizontal plane, a polar angle of 0 degrees thus corresponds to the vertical direction and a value of the polar angle differing from 0 degrees corresponds to a direction of greater or lesser inclination towards the front or rear (if the access opening to the interior 24 is designated as "front" and the back wall 22 is equated with "rear"). The azimuthal angle by contrast designates an angle which is measured along a plane orthogonal to the sectional plane S—again with respect to a normal to the top wall 16. A value of 0 degrees of the azimuthal angle thus corresponds to the vertical direction, whereas a value of the azimuthal angle differing from 0 degrees corresponds to an inclined direction towards the side wall 18 or the side wall 20.

The different shades (levels of grey) in FIGS. 4A to 4F represent different light intensities. It can be seen that the light curtain radiated by the lighting device 32 into the interior 24 has a varying divergence in the polar direction depending on the value of the travel Δy of the printed circuit board 46, the intensity maximum shifting in the polar direction, so that the location of greatest brightness can be displaced selectively towards the front or rear. At the same time, the light curtain remains approximately the same width irrespective of the excursion Δy, as can be seen in FIGS. 4A to 4F from the approximately constant azimuth extent of the intensity profile.

It is understood that the intensity profiles shown in FIGS. 4A to 4F are purely by way of example and serve merely for illustration. Other intensity profiles may of course result, for example depending on the geometry of the reflecting surface 36.

The light module 42 further has a light-permeable covering plate 62 which covers the reflector cavity, delimited by the reflecting surface 36, in the direction of the interior 24 of the refrigerating or freezing apparatus 10. Light which is reflected at the reflecting surface 36 passes through the covering plate 62 before entering the interior 24. The covering plate 62 may be completely transparent. Alternatively, it may have a light-scattering effect. It is composed, for example, of glass or plastics material. The module housing 44 for its part is preferably a plastics part produced by injection molding which may be formed in one piece with a reflector body bearing the reflecting surface 36. Alternatively to this, such a reflector body may be formed separately from the module housing 44 and bonded, latched or otherwise connected thereto.

Figure 5A:
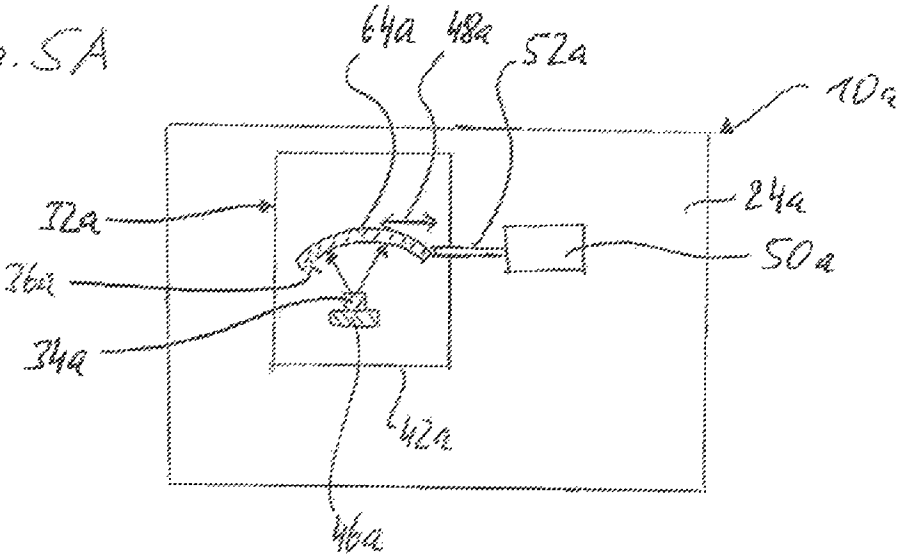
FIGS. 5A-5B show schematically further embodiments of a lighting device for the refrigerating or freezing apparatus of FIG. 1.
Figure 5B:
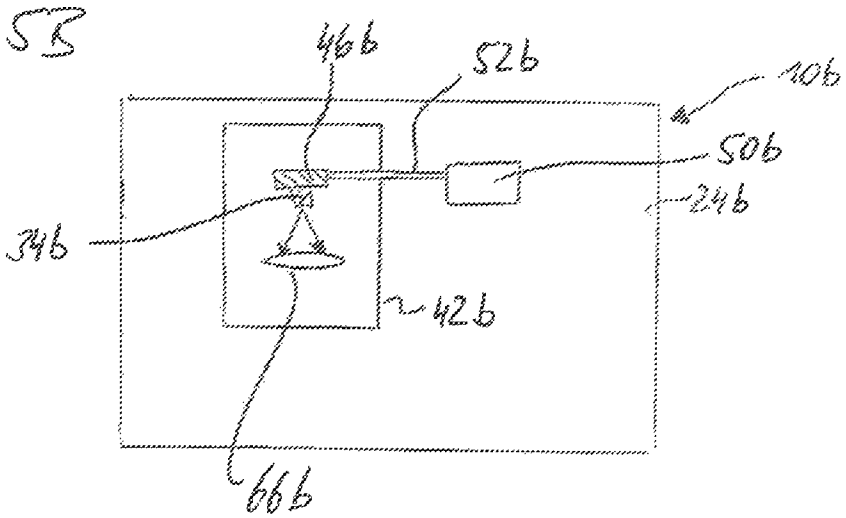

In FIGS. 5A and 5B components which are the same or have the same effect as in the previous figures are provided with the same reference symbols, but supplemented by a lower case letter. Unless otherwise specified below, reference is made to the above statements regarding FIGS. 1 to 3C for the explanation of such components.

In the embodiment according to FIG. 5A, the refrigerating or freezing apparatus 10*a* (here indicated only highly schematically) has a lighting device 32*a* in which the printed circuit board 46*a* with the light-emitting element 34*a* mounted thereon is installed stationarily in the light module 42*a*, whereas a reflector body 64*a* bearing the reflecting surface 36*a* is movable in the direction of the arrow 48*a* by means of the drive device 50*a*. The effect of the displacement of the reflecting surface 36*a* relative to the light-emitting element 34*a* is the same as in the embodiment of FIGS. 2 to 3C, but the moving component (here reflector body 64*a* with reflecting surface 36*a*) is a different one to that in the previous embodiment.

The embodiment of FIG. 5B differs from the previous embodiments in that there is provided a light-permeable element 66*b* which modifies the beam path of light and through which passes the light of the light-emitting element 34*b* before this light reaches the interior 24*b* of the refrigerating or freezing apparatus 10*b*. The light-permeable element 66*b* in the exemplary case shown is represented as a converging lens. Of course, a lens with diverging effect may be used instead of a lens with converging effect. Likewise an optical structure of any desired complexity may be used to obtain such a lens effect (whether it be converging, or whether it be diverging). What is essential for the embodiment according to FIG. 5B is solely that a relative adjustability exists between the light-emitting element 34*b* and the light-permeable element 66*b*, the light-permeable element 66*b* in the concrete exemplary case being installed stationarily in the light module 42*b*, while the printed circuit board 46*b* bearing the light-emitting element 34*b* is positionally adjustable (e.g. rotatable) by means of the drive device 50*b*—similar to the embodiment of FIG. 2. Depending on the position (e.g. angular position) of the printed circuit board 46*b* and thus of the light-emitting element 34*b* relative to the light-permeable element 66*b*, the light beam emerging from the light-permeable element 66*b* changes its direction or/and divergence or/and cross-sectional size, whereby different regions of the interior 24*b* of the refrigerating or freezing apparatus 10*b* can be more intensely illuminated.

It is understood that in a modification of the embodiment according to FIG. 5B, the printed circuit board 46*b* with the light-emitting element 34*b* may be stationarily installed and instead the light-permeable element 66*b* may be positionally adjustably arranged. Likewise it is understood that in the embodiment of FIG. 5B—although not shown there—a reflecting surface analogous to the reflecting surface 36 and 36*b* of the preceding embodiments may be provided. This reflecting surface may be stationarily or positionally adjustably arranged. The light-permeable element 66*b* may be arranged in the light beam path upstream of a covering plate (not shown specifically in FIG. 5B) which, as in the embodiment of FIG. 2, ensures a covering of the light module 42*b* in the direction of the interior 24*b*. Alternatively, it is conceivable to configure the light-permeable element 66*b* as such a covering plate, a lens effect in this case being obtainable by configuring the plate as a Fresnel zone plate.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A refrigerating or freezing apparatus comprising:

a wall and an interior; and a lighting module for illuminating the interior, the lighting module being a constructional unit inserted into a recess formed in the wall, the lighting module including a module housing accommodating at least one light-emitting element and an immovably arranged reflecting surface, in the direction of which the light-emitting element emits a light beam and by which the light beam is reflected in the direction of the interior, the lighting module further including an actuating device to change at least one of a radiating position and a radiating direction of the light beam emitted by the light-emitting element relative to the reflecting surface, wherein the reflecting surface is concavely curved in at least one sectional plane and the light-emitting element is positionally adjustable in the sectional plane relative to the reflecting surface.

2. The refrigerating or freezing apparatus according to claim wherein the actuating device comprises a drive device for the positional adjustment of the light-emitting element.

3. The refrigerating or freezing apparatus according to claim 2 wherein the positional adjustment of the light-emitting element comprises an adjustment having at least one translational component.

4. The refrigerating or freezing apparatus according to claim 2 wherein the positional adjustment of the light-emitting element comprises an adjustment having at least one rotatory component.

5. The refrigerating or freezing apparatus according to claim 2 wherein the light-emitting element is mounted on a printed circuit board, and the printed circuit board is positionally adjustable by means of the drive device.

6. The refrigerating or freezing apparatus according to claim 1 wherein the light-emitting element is movable in the direction from one edge region of the concavely curved reflecting surface to an opposite edge region of the concavely curved reflecting surface.

7. The refrigerating or freezing apparatus according to claim 1 wherein the light-emitting element is adjustable about an axis of rotation perpendicular to the sectional plane with respect to the light-emitting element angular position relative to the reflecting surface.

8. The refrigerating or freezing apparatus according to claim 1 wherein the interior is delimited by a back wall, two side walls opposite one another, a top wall and a bottom wall, and the light-emitting element is positionally adjustable in a sectional plane of the reflecting surface which runs parallel to the two side walls.

9. The refrigerating or freezing apparatus according to claim 8 wherein the lighting module is arranged on the top wall.

10. The refrigerating or freezing apparatus according to claim 1 wherein the reflecting surface is formed by a reflecting trough and the lighting module includes a plurality of light-emitting elements arranged in a manner distributed in a trough longitudinal direction.

11. The refrigerating or freezing apparatus according to claim 10 wherein the plurality of light-emitting elements are positionally adjustable relative to the reflecting trough on a common support along a sectional plane perpendicular to the trough longitudinal direction.

12. The refrigerating or freezing apparatus according to claim 1 wherein the actuating device comprises a control unit adapted to cause a change of the at least one of the radiating position and the radiating direction of the light beam in accordance with a predetermined variation profile.

13. The refrigerating or freezing apparatus according to claim 1 wherein the actuating device comprises a control unit adapted to cause a change of the at least one of the radiating position and the radiating direction of the light beam based on sensory-acquired information with regard to at least one of a user of the apparatus and an interior state of the apparatus.

14. The refrigerating or freezing apparatus according to claim 1 wherein the light-emitting element comprises a light-emitting diode.

15. The refrigerating or freezing apparatus according to claim 1 wherein the lighting module comprises, alternatively or additionally to the reflecting surface, at least one light-permeable element which influences the propagation of at least part of the light of the light-emitting element, wherein the actuating device is adapted to change at least one of the radiating position and the radiating direction of a light beam emitted by the light-emitting element relative to the light-permeable element.

* * * * *